United States Patent [19]

Pavlick et al.

[11] Patent Number: 4,715,292

[45] Date of Patent: Dec. 29, 1987

[54] HEAD END VEHICLE WITH CREW ACCOMMODATIONS WITH LOCOMOTIVE AND OTHER CONTROLS

[76] Inventors: Michael J. Pavlick, 1538 Daws Cir., Norristown, Pa. 19403; James C. McQueston, 466 Hopwood Dr., Warminster, Pa. 18974; Walter S. Eggert, Jr., 26 Moredon Rd.; Lionel Sherrow, 737 Dale Rd., both of Huntington Valley, Pa. 19006

[21] Appl. No.: 776,068

[22] Filed: Sep. 13, 1985

[51] Int. Cl.[4] ..... B61D 15/06; B61D 17/00

[52] U.S. Cl. ..... 105/456; 105/392.5; 105/396

[58] Field of Search ..... 105/26 R, 238 R, 314, 105/315, 327, 329 R, 340, 396, 456, 397, 1 R, 1 A, 61, 342, 392.5; 296/188, 189; 213/1 A, 220

[56] References Cited

U.S. PATENT DOCUMENTS

| | | | |
|---|---|---|---|
| 2,049,401 | 7/1936 | Wallace | 105/456 |
| 3,384,033 | 5/1968 | Ruff | 105/61 |
| 3,479,080 | 11/1969 | Hilfiker | 296/189 |
| 3,802,733 | 4/1974 | Appel et al. | 296/189 |
| 3,831,997 | 8/1974 | Myers | 296/189 |
| 3,848,886 | 11/1974 | Feustel et al. | 296/189 |
| 3,875,869 | 4/1975 | Molnar | 105/314 |
| 4,184,434 | 1/1980 | Chapin | 105/340 |
| 4,533,172 | 8/1985 | Oliver | 296/189 |

FOREIGN PATENT DOCUMENTS

| | | |
|---|---|---|
| 1124536 | 3/1962 | Fed. Rep. of Germany . |
| 2910481 | 9/1979 | Fed. Rep. of Germany . |

*Primary Examiner*—Robert B. Reeves
*Assistant Examiner*—John G. Pido
*Attorney, Agent, or Firm*—E. M. Farrell; H. Foster; T. I. Davenport

[57] ABSTRACT

A lead or head end rail car includes crew living and working accommodations. Controls for the propulsion car, such as a locomotive, and other trailing cars are included in the head end car. Crashworthiness is built into the head end car to provide safety for the engineer and crew in case of accident.

8 Claims, 9 Drawing Figures

HEAD END VEHICLE WITH CREW ACCOMMODATIONS WITH LOCOMOTIVE AND OTHER CONTROLS

BACKGROUND OF THE INVENTION

Cabooses for accommodating crew and equipment are well known. Generally such a caboose is placed in back of a train, as illustrated in U.S. Pat. No. 739,304.

A U.S. Pat. No. 3,875,869 relates to a railway home car and vacation train system and includes a multi-level car with viewing windows above the floor plane.

A U.S. Pat. No. 4,184,434 discloses a locomotive with an enlarged cab having split level sections for accommodating an engineer and other members of the train crew.

None of the patents mentioned above disclose a lead or Head End Car propelled by a locomotive or other propulsion means and none provide the advantages of the present invention, as will be described.

Cabooses have high crew accident rates and their elimination is part of many national labor agreements. Locomotive cab environment is generally unsatisfactory, and limited in the number of crew members it can accommodate.

It is known that locomotives are conventionally very noisy and involve crowded working environments which tend to undermine concentration and operating efficiency of the engineers and other crew personnel. These conditions tend to impair the safety in the entire train operation.

Modern locomotives have been generally designed to place the operator cab out in front of the power units in order to provide the best visibility for drivers. However, this has a disadvantage. of providing little crash protection for operating crews.

OBJECTS OF THE INVENTION

It is an object of this invention to provide an improved lead or head end car with space for a crew and controls for controlling a trailing locomotive or other propulsion means.

It is still a further object of this invention to provide an improved lead or head end car with crashworthiness exceeding those of passenger cars, locomotives and clean cab requirements.

It is still a further object of this invention to provide an improved lead or head end car having passenger car ride quality, low noise level, an environmentally controlled cab and crew quarters, and clean and comfortable work accommodations.

It is still a further object of this invention to provide an improved lead or head end control module or car in which equipment is located above the floor in a protected environment.

It is a further object of this invention to provide an improved or head end car with locomotive control, improved monitoring controls, video and the like.

BRIEF SUMMARY OF THE INVENTION

In accordance with the present invention, a lead or head end car is placed in front of a propulsion car, such as a locomotive and is designed to carry control equipment and crew. The head end car may be sub-divided into compartments with one of the compartments being elevated for visibility. The control equipment controls the operation of the propulsion car and other cars in a train. The car includes a center frame or cage of very high strength for the crew. The car further includes front and rear collapsible portions, on either side of the center frame, which are collapsible to absorb the kinetic energy in the event of a crash. Under a maximum crash situation, the collapsible portions tend to force the center frame upwardly and out of the direct line of the crash forces.

Other objects and advantages of the present invention will be apparent and suggest themselves to those skilled in the art, from a reading of the following specification and claims taken in conjunction with the accompanying drawings.

DESCRIPTION OF THE INVENTION

The present invention will be described in connection with a railroad train for hauling freight from one location to another. As is well known, a typical freight train comprises a string of interconnected freight cars which are propelled along a surface track by a locomotive or other propulsion means.

A train crew generally includes an engineer, a conductor, a brakeman and sometimes additional personnel. The engineer operates the train from a cab in the head end locomotive in prior art systems. The conductor and brakeman are responsible for handling the freight cars. The conductor is in charge of the train and generally communicates with the engineer by radio, by hand, or by other appropriate signals.

The present invention differs from prior art systems insofar as a head end car is provided for the personnel including the engineer, conductor and various crew members and includes controls for controlling the operation of other cars in a train, including the locomotive or other propulsion means. The locomotive or other propulsion means propel the head end car as well as other cars in the train. In a preferred embodiment, the locomotive or propulsion means is located behind the head end car. In effect, the head end car takes the place of providing the accommodations for the engineer and crew and eliminates the need for the use of a caboose. In order to permit the crew members to be carried in one car and still provide good environmental controls including climate controls, noise, cleanliness, and ride quality, it is necessary to provide compartments within the car which may be at different levels and provide means to permit the various crew members to pass from one area or level to another. The head end car of the present invention provides a control panel or other means for controlling various functions within the other cars of the train including the locomotive. In addition to providing control, the head end car provides clear visibility both forwardly and rearwardly.

In providing for all the needs to control and operate the car and to accommodate the crew members, particular care must be taken to provide for the safety of the personnel in the event of a crash. This is particularly important because the head end car will receive the maximum forces from any oncoming vehicle which may be on the tracks. The present invention is directed primarily to the head end car with control means which provides for accommodations for the crew members in a clean and comfortable environmental condition and at the same time provides for maximum safety for the crew in the event of a crash.

Figure 1:
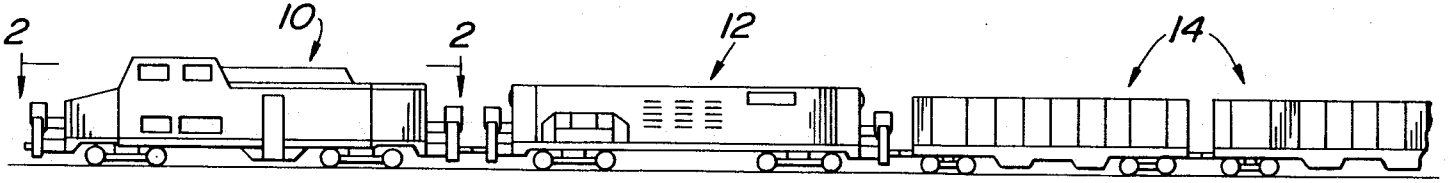
FIG. 1 is a side view of a string of railway cars including a lead or head end car, in accordance with the present inventions.

Referring to FIG. 1, one embodiment of the present invention includes a lead or head end car 10 followed and propelled by a locomotive 12. A plurality of freight cars 14 are hauled by the locomotive 12.

Figure 2:
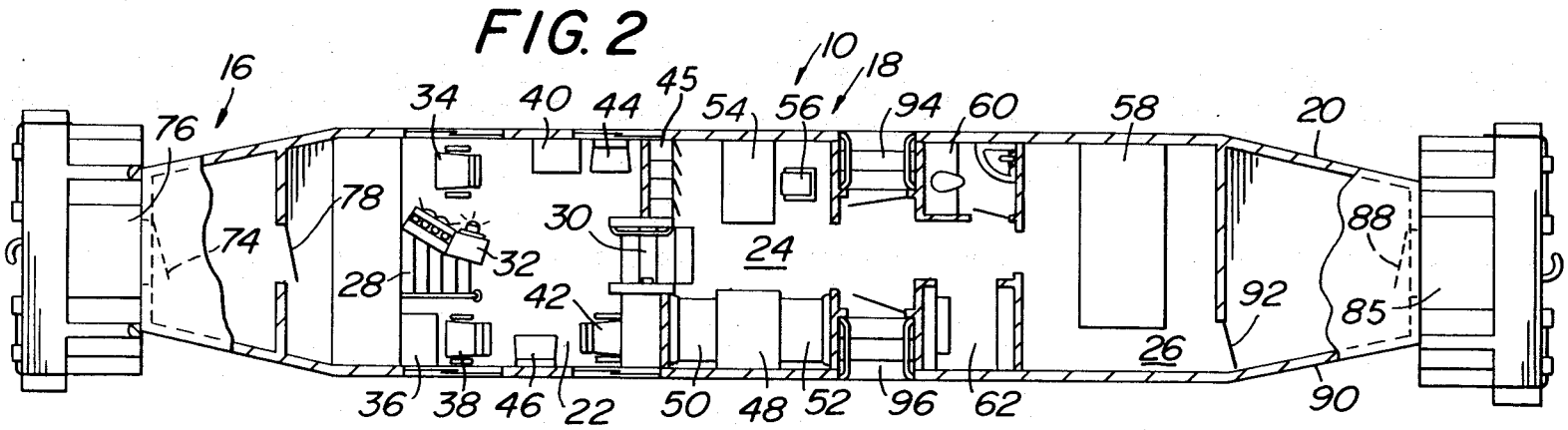
FIG. 2 is a cross sectional view, taken along lines 2—2 of FIG. 1.

Referring to FIG. 2, the head end car 10 is considered as being divided between a front frame portion 16, and center frame portion 18, and a rear frame portion 20. As will be described, the front frame portion 16 and the rear frame portion 20 are designed to collapse in the event of high crash impact. However, the center frame portion 18 may be considered as a super structure or cage and will not collapse upon high impact. Under severe impact, the center frame portion 18 will tend to be moved out of the way of the impact forces in case of crash. As illustrated, the center frame portion 18 includes the working crew.

The center frame portion or cage 18 is divided into partitions or rooms 22, 24, and 26. The various partitions are used for different functions in the head end car.

The partitions or rooms 22 comprise an elevated cab portion. Front steps 28 and rear steps 30 lead from the lower levels into the cab 32. A control unit 32, which may include video or other control elements, is provided for the engineer or operator. A seat 34 is disposed at a relatively high elevation to permit the engineer good visibility to the front and rear. The control unit may include video displays or electrical controls which may be connected to transmit control signals to control various functions in the cars of the train including the locomotive 12. The precise control means are not illustrated because they may take a wide variety of different forms well known to those skilled in the art.

A table 36 and a chair 38 may be provided for an assistant engineer. A refrigerator 40 is also provided in the cab. Another chair 42 is provided to permit a crew member to look rearwardly. Chairs 44 and 46 may be for spectators or people wishing to view the operat1on in the control room. These chairs may normally be folded out of the way when not in use.

The second partition 24 at the lower level of the car end is used for a number of functions. The dining table 48 with the benches 50 and 52 are provided for crew members. Small office facilities are provided by a table or desk 54 and a chair 56. Lockers 45 are provided along a wall in the partitioned area 24.

The final main compartment 26 includes a motor and/or generator 58 and provides the auxiliary power for the lead car 10. Partitioned area 60 is provided to serve as a bathroom and an area 62 is provided to store electrical equipment including batteries and the like.

The center frame portion 18 is designated to include all "hotel" power. This includes auxiliary power for lighting and utilities. Also, water and plumbing services are readily available for the crew members.

Figure 7:
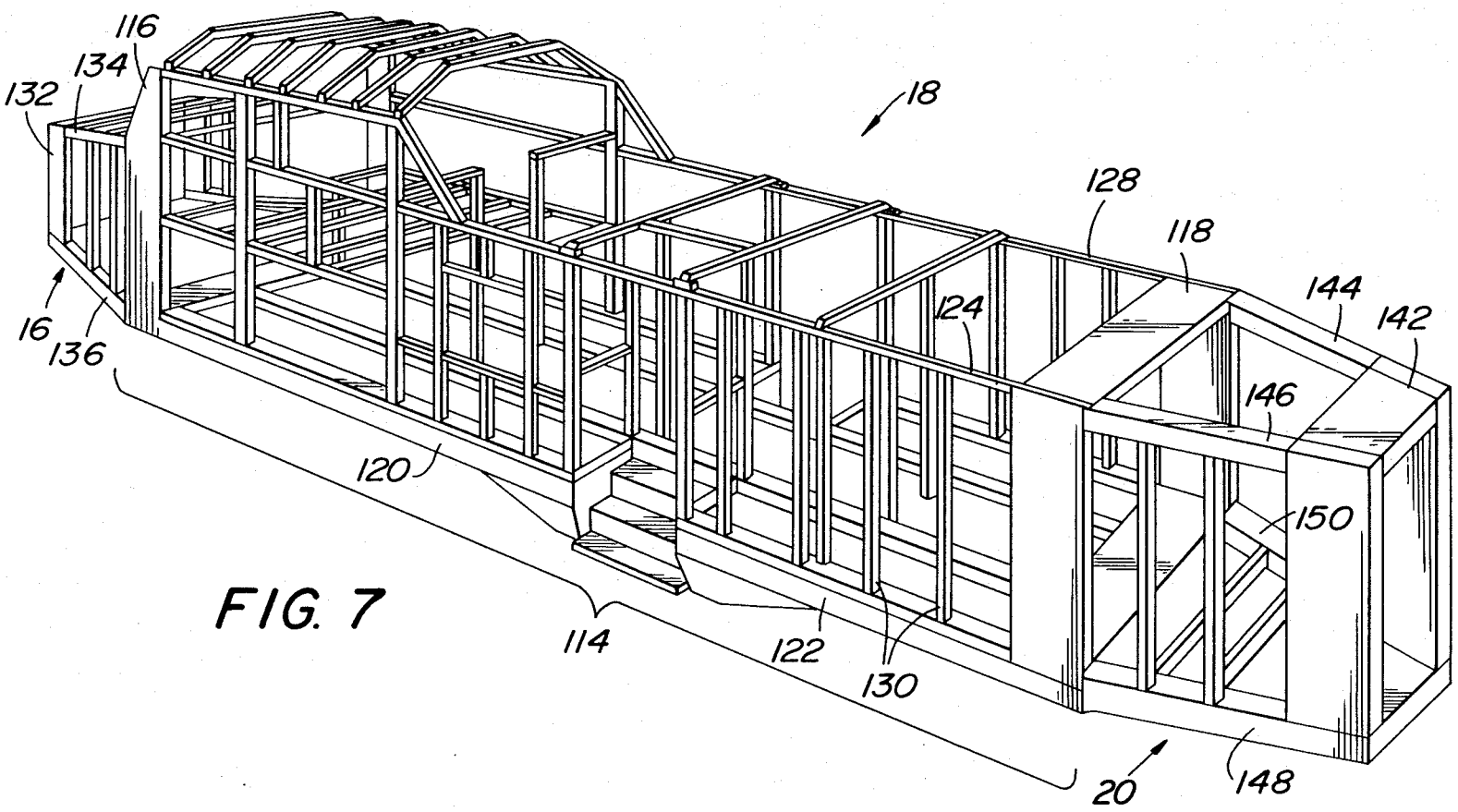
FIG. 7 is an isometric view illustrating a frame structure for a lead or head end car, in accordance with the present invention.

The front frame section 16 and the rear frame section 20 are designed along similar lines as illustrated in FIG. 2 along with FIG. 7. The front section 16 includes a bumper 64, a front structure 66, steps 68 and a rail 70. A section 72 is designed to collapse under relatively high impacts, as will be described. A door 74 leads from the platform 76, a second door 78 leads into the main section of the car with the steps 28 leading into the cab partition 22. In like manner the rear portion includes a bumper 80, a structural support 82, steps 84 and a rail 85. A platform floor 86 leads to a door 88 into a crushable section 90. From the interior of the crushable section a door 92 leads to the compartment or partition 26 which includes the auxiliary power equipment.

Figure 3:
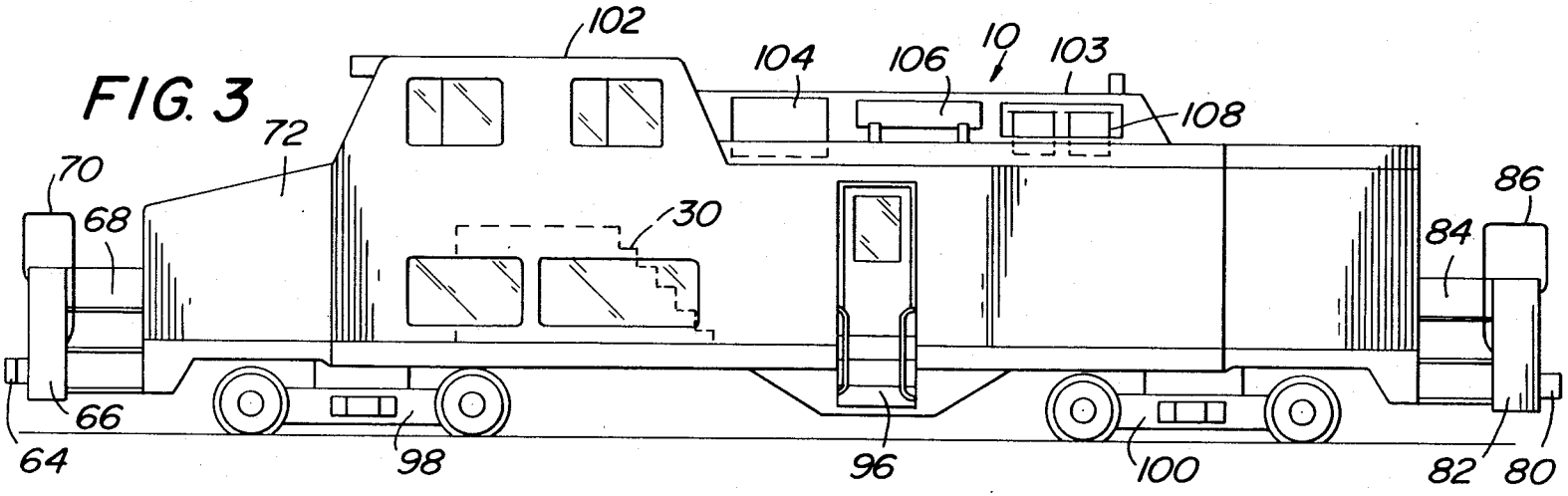
FIG. 3 is an enlarged side view of the lead or header car illustrated in FIG. 1.

Steps are provided on both sides of the car. In addition, center steps 94 and 96 are provided. Among other things, these steps provide means of exit in case of a crash which will prevent the front end rear steps from being used. As illustrated in FIG. 3, the head end car 10 is supported by a pair of conventional trucks 98 and 100. An elevated cab 102 provides visibility for the engineer towards the front and rear as well as to the sides. An auxiliary roof 103 includes a number of units for the operation of the car as well as for the comfort of the crew. These include an air ronditioner 104, a water tank 106 and air filters 108.

Figure 4:
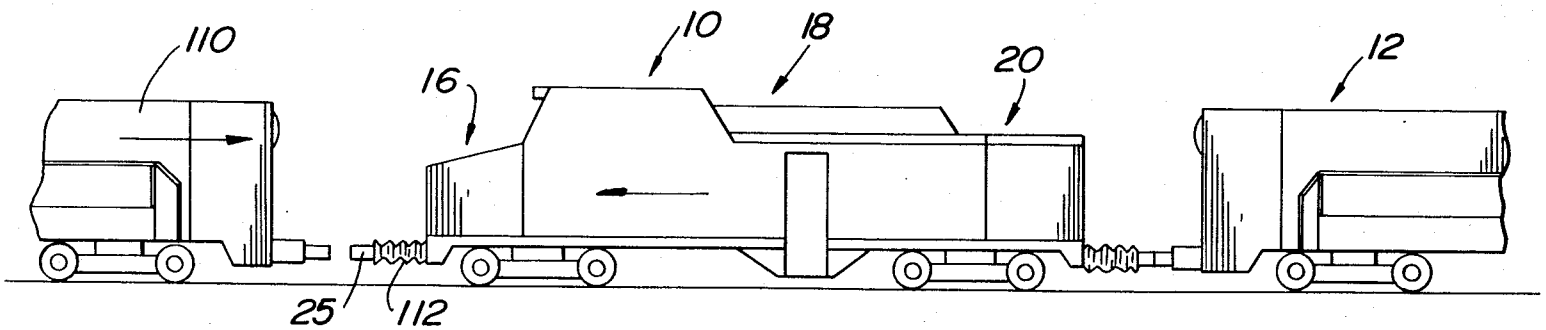
FIG. 4 illustrates a situation in which the lead or header car is about to collide with another car coming in the opposite direction.
Figure 5:
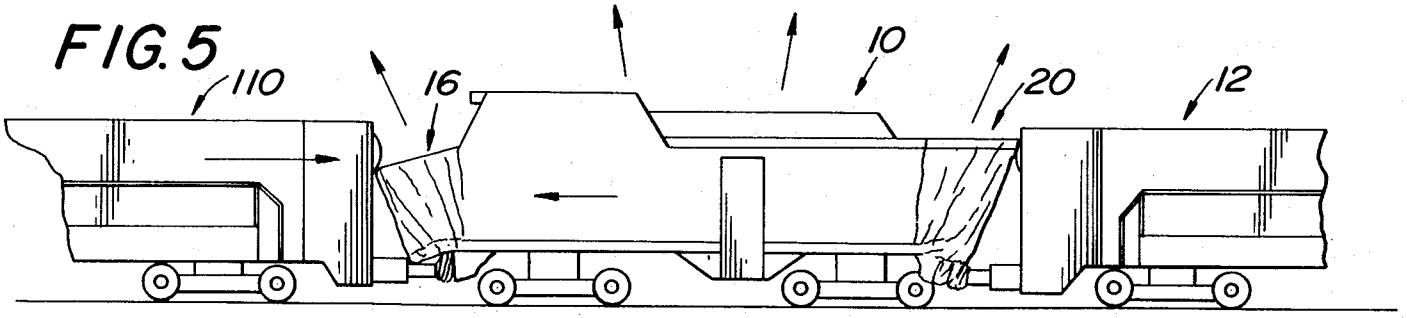
FIGS. 5 and 6 illustrate conditions and positions of the lead or head end car when maximum crash forces are encountered.
Figure 6:
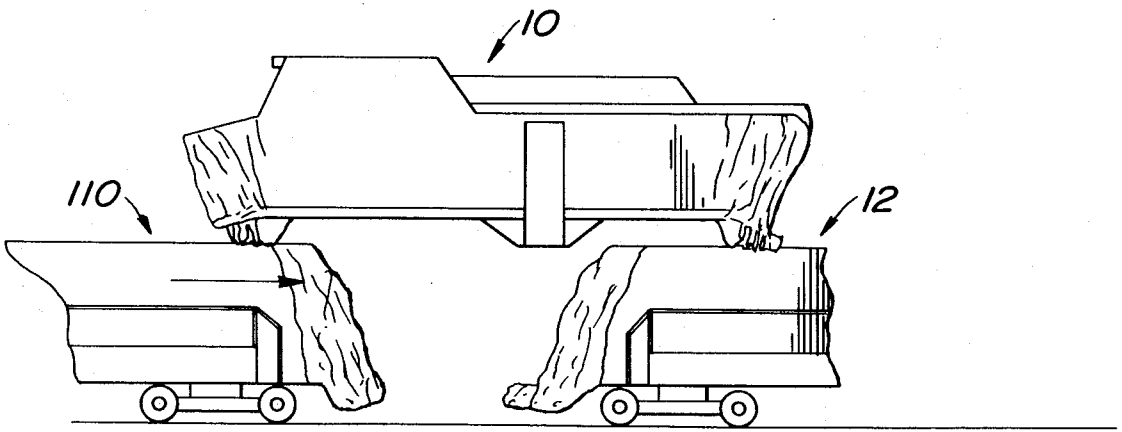

Referring to FIG. 4, a situation is illustrated in which the head end car 10 pushed by the locomotive 12 is being approached by an oncoming car 110 which is about to crash into the head car 10. FIGS. 5 and 6 illustrate what happens upon severe impact. Various parts relating to the steps and other structure are omitted in FIGS. 4, 5 and 6 in order to illustrate the crash of the car 10 and what happens upon impact.

The front and rear of the car 10 are adapted to collapse in steps. At low velocity impacts the bumpers, such as the bumper 25 is sufficient to absorb the shock. As the impact forces are increased a spring member 112 starts to cushion the impact. As illustrated in FIGS. 5 and 6, on high impacts when the resistance of the spring 24 and the spring 112 are overcome, the end sections 16 and 20 will start to collapse. The end sections 16 and 20 are designed with collision bulkheads towards the front and connected by collapsible tubes to the ends of the main control frame 18 so that on high impact, the structure 16 and 20 will tend to collapse.

Referring to FIGS. 5 and 6, there is illustrated a situation in which the bumper and spring resistances are overcome and the end sections 16 and 20 start to collapse. The start of the collapse is illustrated in FIG. 5. After the collapse of the portions 16 and 20, the impact forces from the car 110 and the locomotive 12 continue to be applied to the central frame 18 of the car 10. However, the center super shell or cage 18 will be maintained in tact because of its high strength structural characteristics. The car 10 is then forced upwardly in the direction of the arrows illustrated in FIG. 5 out of the way of the impact forces produced by the cars 110 and the locomotive 12.

When the car 10 is lifted upwardly and rests on the car 110 and the locomotive 112, it may tend to roll.

Because of the super structural elements used in the frame portion of the center portion or cage 18, the central portion 18 will tend to roll without collapsing, thereby protecting the crew to a great extent from serious injury.

Referring to FIG. 7, the frame structure which may be used with the head end car 10 is illustrated. The center or cage area 18 is illustrated by a line 114. The center portion 18 involving a super structure cage are made of extremely strong members to permit high impacts and to permit rolling without collapsing. A pair of bulkhead collision frames 116 and 118 are disposed on opposite sides of the center portion 18 of the car 10. These frames are made up of extremely thick and heavy structural member welded together. Various heavy side members such as side sills 120 and 122, are disposed on both sides of the car are designed to absorb side impacts. Various longitudinal beams, such as beams 124 and 128 are designed to absorb impacts from the ends of the car. Various vertical beams 130 are provided to unite the longitudinal beams and to support the roof of the car. The entire frame illustrated in FIG. 7 is constructed to receive the exterior as illustrated in the previous figures.

The front portion 16 includes a front collision bulkhead 132 which is a heavy structural frame member capable of absorbing energy without deforming. Four tubular members, of which only two members 134 and 136 are illustrated, are connected between the bulkhead 132 and the central frame bulkhead 116. The tubular members 134 and 136 are constructed and angularly disposed at the top rail so that they are the tubular member predisposed to collapse upon relatively high impact. Consequently when a high impact is produced against the front collision bulkhead 132 the tubular members 134 and 136 will collapse as the bulkhead frame 132 moves closer to the bulkhead collision frame 116. In collapsing, the tubes 134 and 136 absorb energy which may be transmitted to the main body of the car. In the event that the energy level is extremely high, a condition as illustrated in FIGS. 5 and 6 will take place. Various posts and transverse beams are provided in the space between bulkheads 132 and 116 to permit the side walls and roof of the car 10 to be attached to the end portions of the car thereto.

The rear portion 20 operates substantially the same as the front portion 16 in the event of impact. The rear portion 20 includes a rear bulkhead 142 capable of withstanding extremely high impact. Tubular members 144, 146, 148 and 150 are connected between bulkheads 118 and 142 and are predisposed to collapse in the event of extremely high impact in the manner described in connection with the front portion 16.

When the front and rear portions 16 and 20 collapse as a result of a high impact applied thereto, the bulkheads 132 and 142 will tend to approach the bulkheads 116 and 118, respectively. When the bulkheads 132 and 142 have moved as far as they can move, the central frame area 18 will be pushed upward and rolled out of the way of the oncoming impact forces thereby affording some protection for the crew members disposed within the central portion 18.

Figure 8:
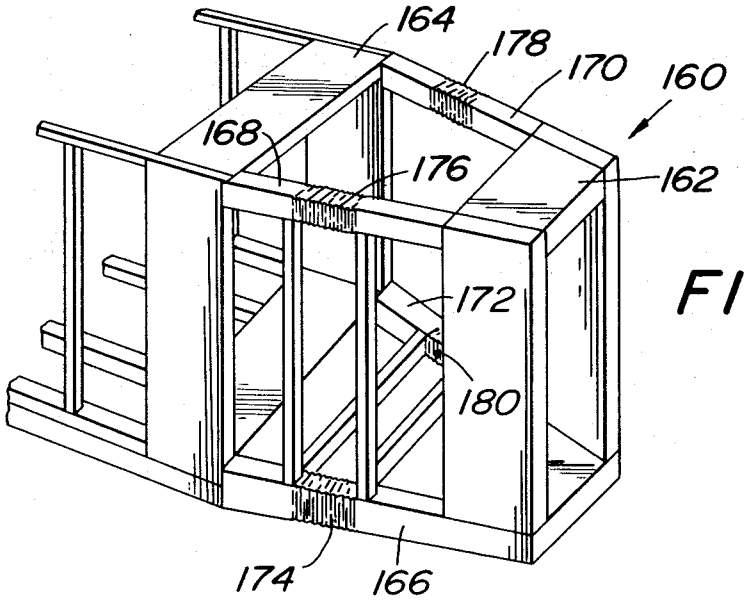
FIG. 8 is an isometric view of another embodiment of a front collapsible structure, in accordance with the present invention, and, FIG. 9 illustrates the head end car of the present invention with different types of rail cars in the train than those illustrated in FIG. 1.

Referring to FIG. 8, a front portion 160 is somewhat similar to the front portion 20 of FIG. 7. In this figure, the vertical posts are omitted. Bulkheads 162 and 164 are spaced from each other and connected by tubular members 166, 168, 170 and 172. The tubular members 166, 168, 170 and 172 include corrugations 174, 176, 178 and 180, respectively. This corrugation is provided to predispose the tubular members to collapse upon high impacts. The front portion 160 will collapse in the manner previously described in connection with the portion 20.

In some cases, small openings or notches may be inserted in the tubular members to predispose them to collapse. Special shaping of the tubular members may also be used.

Figure 9:
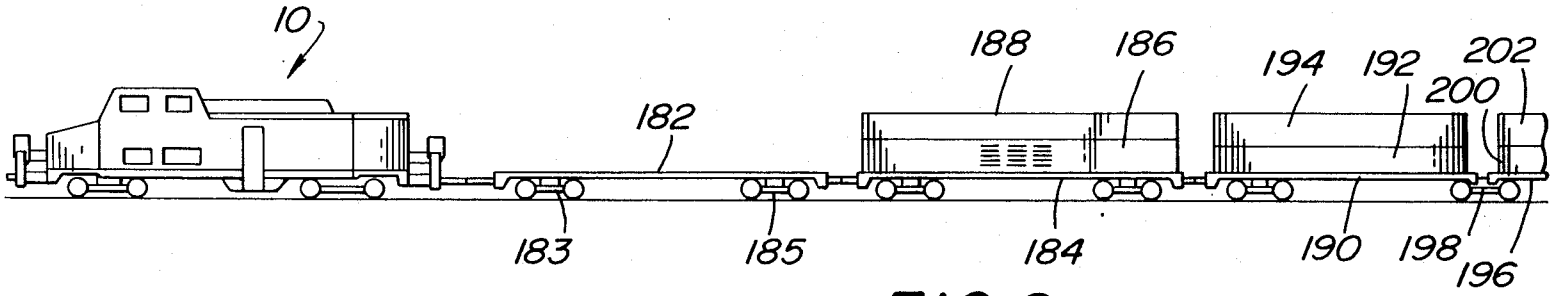

Referring to FIG. 9, a different type of train is used with the head end car i.e. a flat car 182 carried by a pair of trucks 183 and 185 follows the head end car.

The next car 184 carries a power unit 186 which may include the propulsion means necessary to propel all the car 186, which in turn propels all the cars in the train including the head end car 10. This may include motors, generators and other power equipment. The means for controlling the equipment in the power unit 186 is in the head end car 10. A container 188 may be stacked on the power unit 184. It is thus seen in this embodiment that the propulsion car need not immediately follow the head end control car.

The next car 190 carries a pair of stacked containers 190 and 194. The next car 196 also carries a pair of stacked containers 200.and 202. The cars 190 and 196 are supported on one end by a single truck 198, which provides articulation. Low level freight cars with articulation are described in U.S. Pat. No. 4,456,413.

The present invention has provided a head end car which includes complete accommodations for various crew members. At the same time, because of the inherent hazards of being the head end of a train, the invention has provided a head end car which is capable of absorbing energy up to reasonably high impacts. In the event of extremely high impacts, means are provided to in effect push the car out of the path of the impact forces thereby providing some safety for the crew inside the head end car.

Various cables carrying the control signals from the head end control cars to the other cars, including the locomotive or other propulsion means, are not illustrated because such connections are known to those skilled in the art. While not a preferred embodiment, it is recognized that the control car may sometimes be hauled by propulsion means in front with the control car still providing crew accommodations and controls for the rest of the car units in the train.

What is claimed is:

1. In combination:

(a) a non-propulsion control rail vehicle providing a lead car in a train;

(b) a self-propelled rail vehicle including propulsion means for directly pushing said lead vehicle;

(c) said control vehicle including a main body having a plurality of floor levels therein and including a plurality of partitioned areas to provide working areas and accommodations for a crew;

(d) one of said partitioned areas including a cab area having a highest floor level in said control vehicle to permit high visibility in forward and rear directions;

(e) front and rear structures on the front and rear ends of said control vehicle disposed to collapse and absorb energy when subjected to impact forces;

(f) a central frame structure including said cab area disposed between said front and rear structures, and (g) said central frame including protective members to limit the distance said front and rear structures will collapse when high impact forces are applied thereto to prevent the collapse of said central frame.

2. A rail vehicle as set forth in claim 1 wherein said central frame portion includes a plurality of spaced beams connected to resist impact forces and said protective members comprise heavy bulkhead frames.

3. A rail vehicle as set forth in claim 2 wherein said front and rear collision structures comprise bulkhead frames spaced from said bulkhead frames of said central frame portion and having tubular members connected between said collision bulkheads and the bulkhead frames of said central frame portion said tubular members being predisposed to collapse under high impacts.

4. A rail vehicle as set forth in claim 3 wherein said tubular members include corrugations.

5. A rail vehicle as set forth in claim 3 wherein said lead vehicle includes front and rear bumpers disposed toward the lower portions of said front and rear structures and disposed to receive the initial impacts resulting from a collision.

6. A vehicle as set forth in claim 5 wherein said bumpers crush the bottom areas of said front and rear structures and tend to push said central frame portion upwardly out of the line of impact forces when said forces exceed predetermined levels.

7. A rail vehicle as set forth in claim 6 wherein a pair of center side doors for exiting and entering the vehicle are disposed between the ends of said vehicle.

8. A vehicle as set forth in claim 7 wherein hotel power is provided in said vehicle including auxiliary power for lighting and utilities, a water supply and plumbing services.

* * * * *